US012781361B2

(12) United States Patent
Chien et al.

(10) Patent No.: US 12,781,361 B2
(45) Date of Patent: Nov. 3, 2026

(54) ELECTRODE FOR OXIDATION OF NITROGEN-CONTAINING COMPOUNDS, PREPARATION METHOD AND APPLICATIONS THEREOF

(71) Applicant: Feng Chia University, Taichung City (TW)

(72) Inventors: Andrew C. Chien, Taichung City (TW); Guo-Shun Hsu, Taichung City (TW); Shou-Hsun Cheng, Taichung City (TW)

(73) Assignee: Feng Chia University, Taichung City (TW)

( * ) Notice: Subject to any disclaimer, the term of this patent is extended or adjusted under 35 U.S.C. 154(b) by 677 days.

(21) Appl. No.: 18/312,044

(22) Filed: May 4, 2023

(65) Prior Publication Data

US 2023/0374677 A1 Nov. 23, 2023

(30) Foreign Application Priority Data

May 23, 2022 (TW) ..... 111119154

(51) Int. Cl.

| | |
|---|---|
| ***C25B 11/061*** | (2021.01) |
| ***C25B 1/02*** | (2006.01) |
| ***C25B 9/15*** | (2021.01) |
| ***C25B 9/19*** | (2021.01) |
| ***C25B 11/075*** | (2021.01) |

(52) U.S. Cl.

CPC ..... *C25B 11/061* (2021.01); *C25B 1/02* (2013.01); *C25B 9/15* (2021.01); *C25B 9/19* (2021.01); *C25B 11/075* (2021.01)

(58) Field of Classification Search

CPC ..... C25B 11/061; C25B 1/02

See application file for complete search history.

(56) References Cited

PUBLICATIONS

Geng et al. Nickel Ferrocyanide as High-Performance Next Generation Electrocatalyst for Urea Oxidation; found at. https://www.researchsquare.com/article/rs-67358/v1, Sep. 20, 2021.*

Feng, Journal of Alloys and Compounds 881 (2021) 160603.*

Shanmugavani, Materials Letters 304 (2021) 130593.*

Bakar, Materials Today: Proceedings 60 (2022) 1036-1041.*

* cited by examiner

*Primary Examiner* — James M Mellott

(74) *Attorney, Agent, or Firm* — Best & Flanagan LLP

(57) ABSTRACT

The present invention provides a high-performance electrode capable of oxidizing nitrogen-containing compounds prepared by a special microwave method and constructs an electrolysis system and apparatus suitable for oxidizing nitrogen-containing compounds and producing hydrogen and generating electricity by the produced hydrogen; particularly suitable for, but not limited to, recycling large amounts of pig, cattle, or sheep urine in livestock farms. The use of high-performance electrolysis apparatus to decompose the urea in animal urine to obtain hydrogen, then to convert the hydrogen into usable energy for power generation, successfully incorporates livestock waste into electrolysis hydrogen and power generation technology, which not only effectively solves the organic pollution problem, but also produces a clean and environmentally friendly new renewable energy source.

13 Claims, 14 Drawing Sheets

ELECTRODE FOR OXIDATION OF NITROGEN-CONTAINING COMPOUNDS, PREPARATION METHOD AND APPLICATIONS THEREOF

FIELD OF INVENTION

The present invention relates to an electrode, more particularly to a new type of electrode capable of oxidizing nitrogen-containing compounds, electrolyzing, for example, the oxidative decomposition of urea in animal urine to obtain hydrogen, and subsequently providing for power generation technology.

The primary application of the electrode provided in the present invention is to oxidize and electrolyze the urea in animal urine or wastewater to obtain hydrogen for power generation technology, but the present invention is not limited to the practice of electrolyzing only animal urine, other similar substances which contain nitrogen compounds that can be decomposed by electrolysis method should be within the scope of the technical field of the present invention.

BACKGROUND OF THE INVENTION

Hydrogen ($H_2$) is considered to be one of the world's most important energy sources for the future, not only as a source for most chemical production but also as a reactant for fertilizers production. Therefore, the technology of hydrogen production has been the main topic of recent scientific research.

Animal excrement (such as urine) from cattle, sheep, or pig is the most widely produced waste on earth, causing not only environmental pollution but also a heavy burden on farmers in terms of disposal costs. However, urine contains a large amount of urea, an organic component that is rich in hydrogen, carbon, oxygen, and nitrogen. If the urea in urine can be converted by an appropriate method to produce hydrogen and energy which can be used, it will be of great benefit to these wastewater and waste discharges as well as the environmental impact.

To effectively electrolyze urea and convert it into hydrogen, the electrode in the electrolysis apparatus is one of the most important factors. At present, the electrodes are mainly made of precious metals such as platinum, iridium, or rhodium, but the high price makes it difficult to realize the practical application of these precious metal electrodes. Although there are some aluminum electrodes in commercial use, aluminum is not suitable for electrolyzing urea to produce hydrogen due to its oxidation problem. Therefore, there is a lack of a new type of electrode that has been considered for both cost and electrolytic efficiency.

SUMMARY OF THE INVENTION

In order to solve the problems that the cost of existing precious metal electrodes is too high and commercial aluminum electrodes are not suitable for use in urea electrolysis and hydrogen production technology, the present invention provides an electrode for oxidizing nitrogen-containing compounds. The electrode comprises a porous nickel foam carrier having multiple dendritic or flower-like structures, each dendritic or flower-like surface being distributed with modified inorganic and/or organic functional groups containing cobalt oxide fluoride, cobalt phosphide, hydroxide nickel fluoride, phosphorus, or a combination thereof.

In accordance, the present invention also provides a method to prepare electrodes for oxidization of nitrogen-containing compounds. The method comprises steps of: i) providing a nickel foam electrode; ii) immersing the nickel foam electrode in a precursor solution containing precursors; stirring or evenly dispersing the precursor solution containing the nickel foam electrode and precursors; iii) irradiation of the precursor solution containing the nickel foam electrode and precursors in a microwave oven after completion of the dispersion; iv) drying the microwave-treated nickel foam electrode; and v) annealing the dried nickel foam electrode to obtain a nitrogen-containing compound oxidation electrode.

By the above description, it can be seen that the present invention has the following beneficial effects and advantages:

1. The present invention uses a newly developed high-performance electrode to construct an electrolysis system and apparatus suitable for oxidizing any nitrogen-containing compounds and producing hydrogen, and for generating electricity from the hydrogen produced. It is particularly suitable for, but not limited to, recycling large amounts of pig, cattle, or sheep urine in livestock farms. By using the high-performance electrolysis apparatus to decompose the urea in animal urine to obtain hydrogen, and then converting the hydrogen into usable energy for power generation, livestock waste is then successfully incorporated into the electrolyzing and hydrogen generation technology, which can not only effectively solve the organic pollution problem, but also produce a clean and environmental friendly renewable energy.

2. The present invention uses nickel metal, which is less expensive than the existing precious metal, and makes it into a high-performance electrolytic electrode by a special manufacturing process. Nickel metal has the advantages of low cost, wide source, good processing stability, and low toxicity with higher current densities and lower electrochemical oxidation potentials than precious metals, which means that nickel metal not only lowers cost but also requires less energy in the whole electrolysis system in accordance with the cost-saving effect of mass production.

3. The electrodes provided by the present invention mainly use a microwave method, so that the nickel foam electrode immersed in the precursor solution can quickly and uniformly go through a chemical synthesis reaction. The microwave energy has the advantage of being fast and uniform, compared with the traditional direct heating method. Microwave irradiation can make components in the precursor solution components interact with each other, improving the reaction rate and significantly shortening the reaction time to reduce the generation of by-products.

Many of the attendant features and advantages of the present invention will become better understood with reference to the following detailed description considered in connection with the accompanying figures and drawings.

BRIEF DESCRIPTION OF THE DRAWINGS

The steps and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1A:
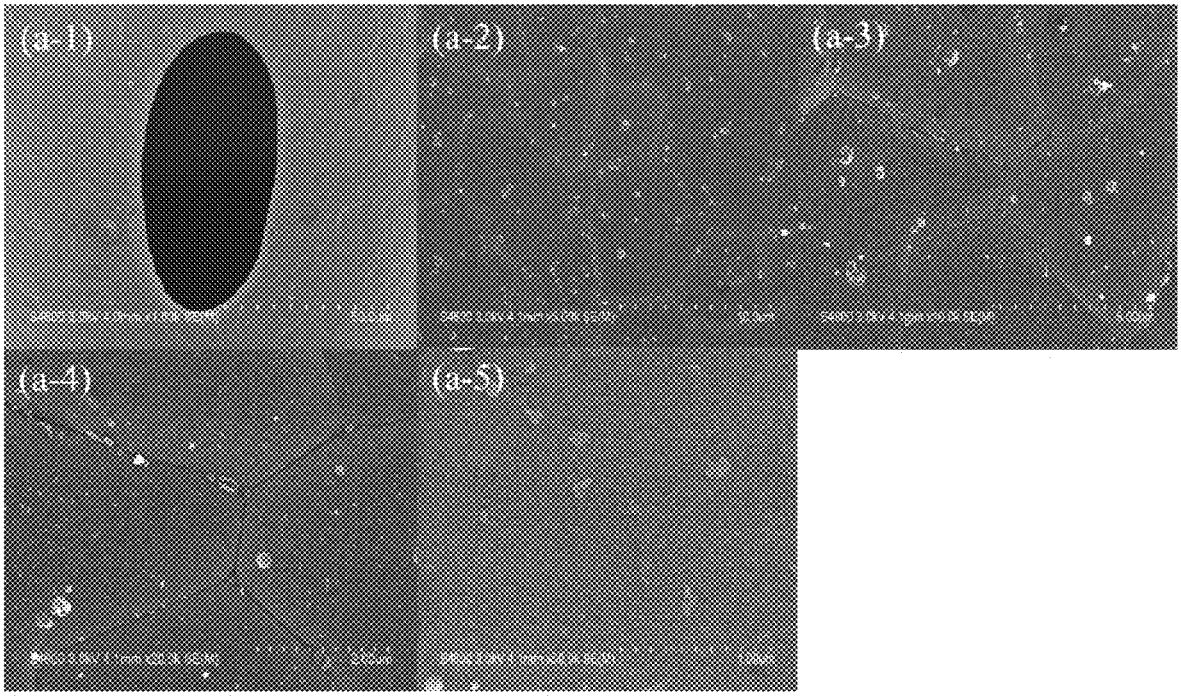
FIG. 1A to FIG. 1E are scanning electron micrographs of the unmodified nickel foam carrier, the nickel foam electrode subject to microwave modification method using precursor of cobalt hydroxide fluoride, cobalt phosphide, hydroxide fluoride, and phosphide, respectively.

Reference will now be made in detail to the present preferred embodiments of the invention, examples of which are illustrated in the accompanying drawings. Wherever possible, the same reference numbers are used in the drawings and the description to refer to the same or like parts. It is not intended to limit the method by the exemplary embodiments described herein. In the following detailed description, for purposes of explanation, numerous specific details are set forth in order to attain a thorough understanding of the disclosed embodiments. It will be apparent, however, that one or more embodiments may be practiced without these specific details. As used in the description herein and throughout the claims that follow, the meaning of "a", "an", and "the" may include reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to.

<Electrode>

The present invention provides an electrode capable of oxidizing nitrogen-containing compounds, which is a porous nickel foam carrier, the surface of which is distributed with modified inorganic and/or organic functional groups comprising cobalt oxide fluoride (Co(OH)F), cobalt phosphide (Co—P), nickel hydroxide fluoride (Ni(OH)F), phosphorus (P), or a combination of the four.

Figure 1B:
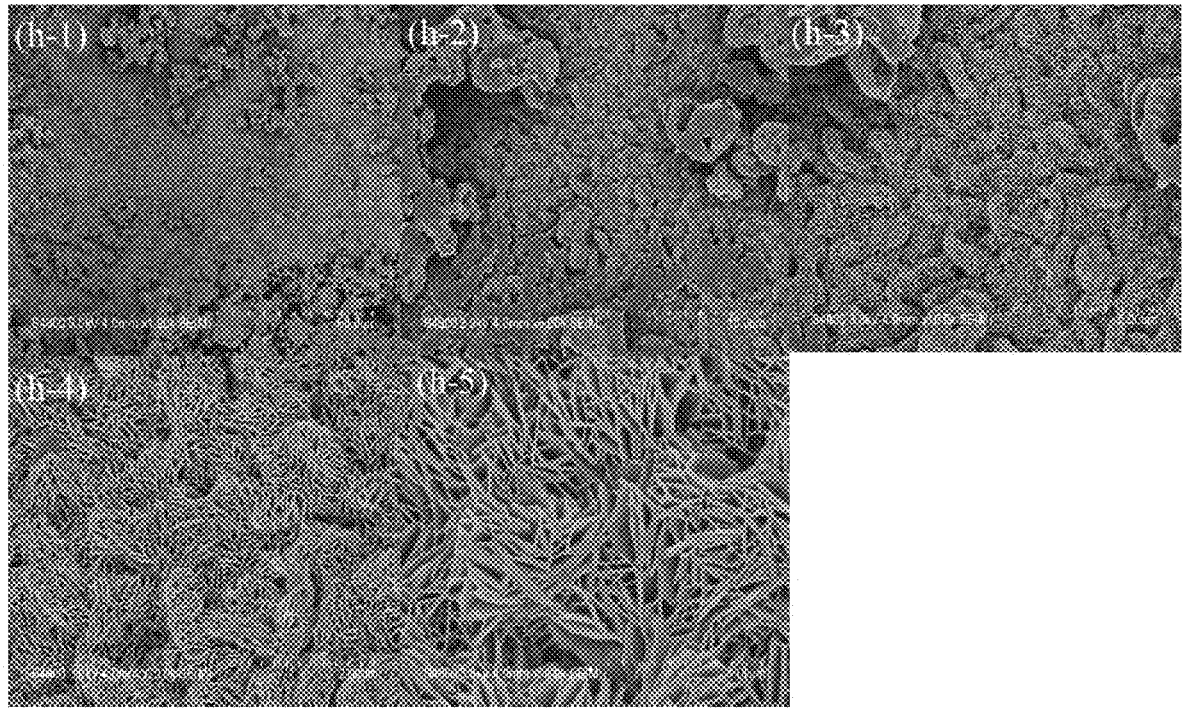
Figure 1C:
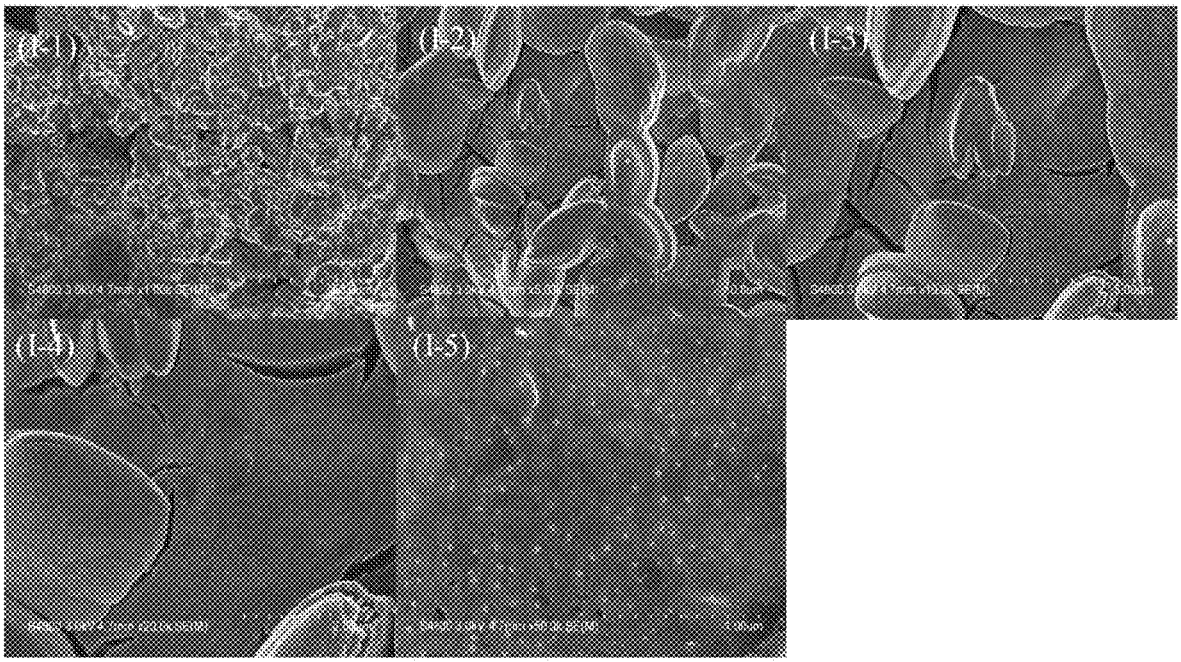
Figure 1D:
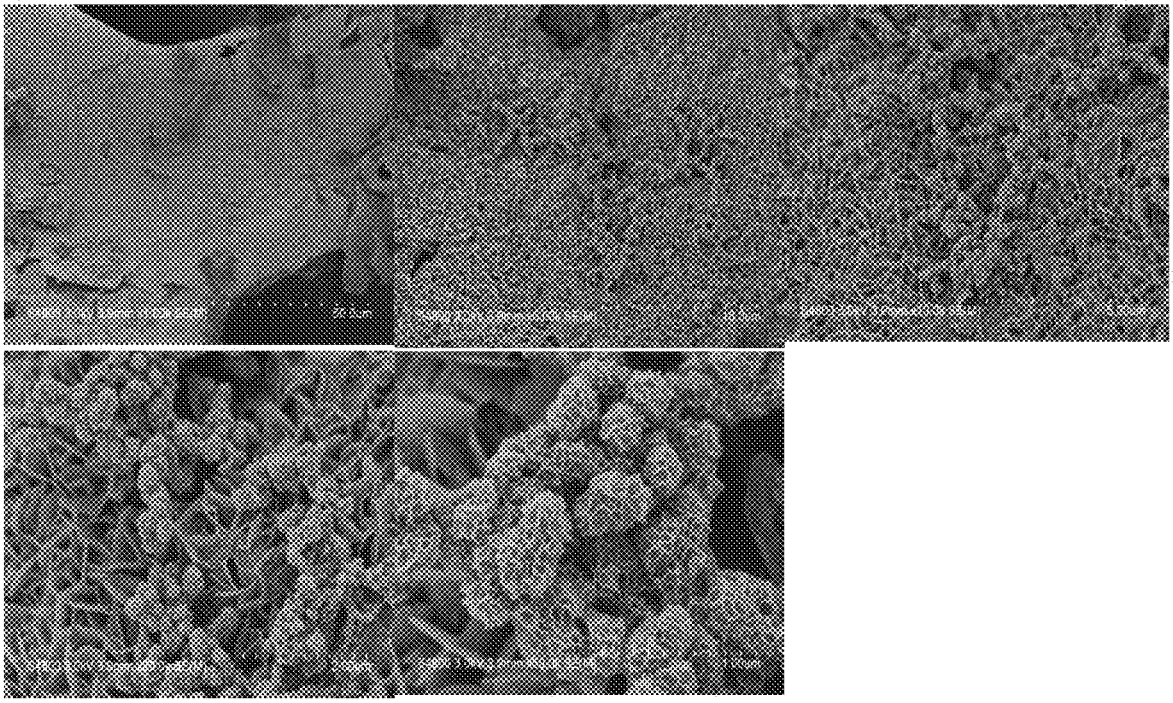
Figure 1E:
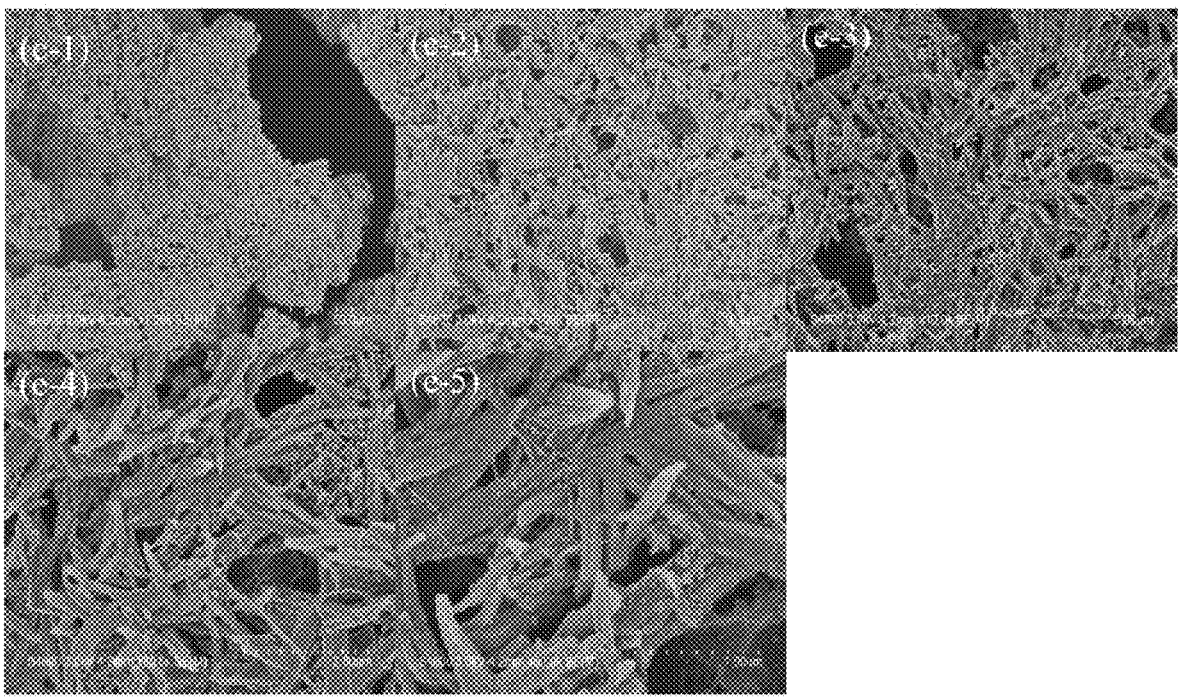

Please refer to FIG. 1A to FIG. 1E, they are the electron microscope diagrams of the unmodified nickel foam electrode of FIG. 1A, the nickel foam electrode subject to the microwave radiation method using cobalt hydroxide fluoride of FIG. 1B, cobalt phosphide of FIG. 1C, nickel hydroxide fluoride of FIG. 1D, and the phosphide of FIG. 1E of the present invention, respectively.

The SEM image shows the surface of the unmodified nickel foam electrode in FIG. 1A is smooth without pores, while the modified nickel foam in FIGS. 1B to 1D of the present invention has grown multiple dendritic or flower-like structures.

Electrode Preparation Method Embodiment 1

Figure 2:
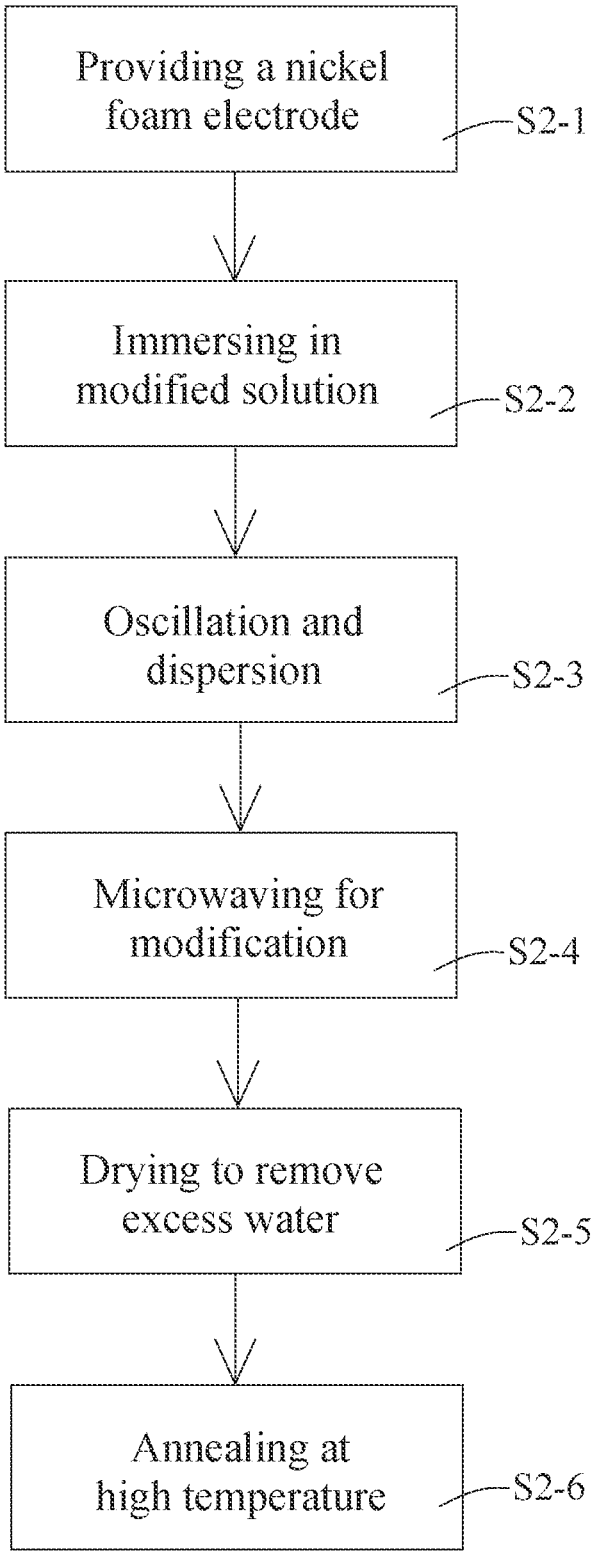
FIG. 2 is a flow chart of the first preferred embodiment of the preparation method of the nickel foam electrode of the present invention.

The present invention further provides a preparation method for the electrode above, with reference to FIG. 2, the steps of which comprise:

Step 2-1) Providing a nickel foam electrode;

Step 2-2) Immersing the nickel foam electrode in a solution containing precursors;

Step 2-3) Placing the precursor solution containing the nickel foam electrode and precursors in an ultrasonic washing machine for 30 minutes to completely disperse contents in the precursor solution;

Steps 2-4) Microwave irradiating the precursor solution containing the nickel foam electrode and precursors in a microwave oven with a power of 700~1000 W for 10 seconds each time for a total of 20 minutes;

Steps 2-5) Drying of the microwave-treated nickel foam electrode in an oven to remove the excess of the solvent, preferably at 120° C. for 8 hours to remove the excess liquid or water; and Steps 2-6) Introducing argon to anneal the dried nickel foam electrode at 320° C. for 2.3 hours in a high-temperature tube furnace to obtain an electrode capable of oxidizing nitrogen-containing compounds (or a nitrogen-containing compound oxidation electrode).

The present invention uses the microwave method to make the nickel foam electrode in the precursor solution, providing advantages of quick and homogeneous chemical synthesis reaction. Microwave energy has the advantage of being fast and uniform, compared with the traditional direct heating method. Microwave can make the components in the precursor solution interact with each other and enhance the reaction rate.

Figure 3:
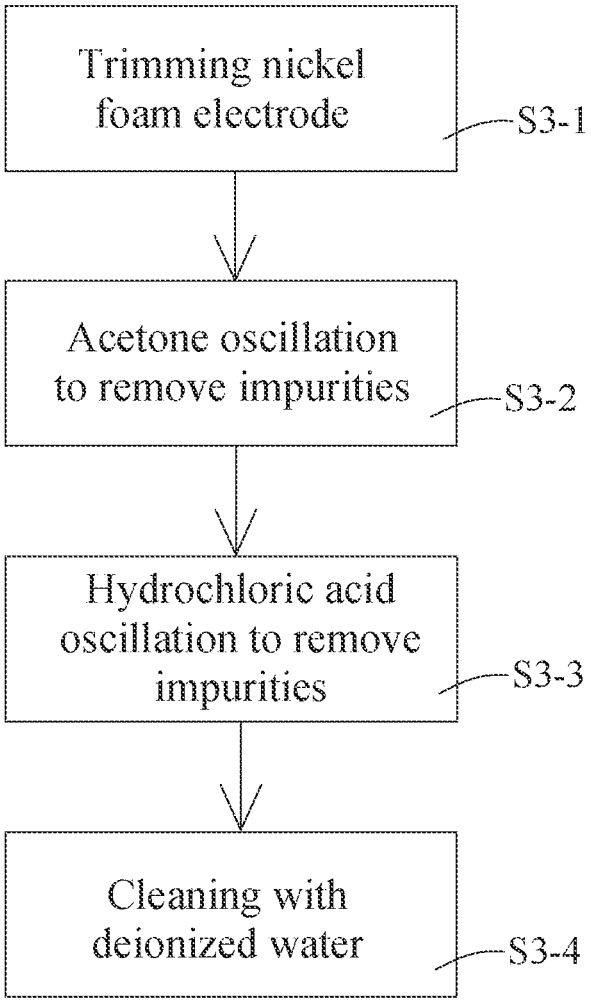
FIG. 3 is a flow chart of a preferred embodiment of the pretreatment method of the nickel foam electrode of the present invention.

Further, prior to the above step 1, the nickel foam electrode may optionally be pretreated to remove impurities from the large specific surface area thereof, see FIG. 3, the steps of which include:

Step 3-1) Cutting the nickel foam electrode to a workable size;

Step 3-2) Using acetone to remove the impurities from the nickel foam electrode by an ultrasonic oscillator;

Step 3-3) Adding 50 ml of 3M hydrochloric acid (HCl) and ultrasonic oscillation for 30 minutes; the hydrochloric acid can completely remove the impurities from the surface and pores of the nickel form electrode; and Steps 3-4) Cleaning the residual acidic components with deionized water (DI) and drying them in an oven at 80° C. to obtain a clean nickel foam electrode ready for the aforementioned surface-modification step.

Please refer to the following Table 1 for several embodiments of the ingredients contained in the aforementioned precursor solution.

TABLE 1

| Embodiment | Contents | Quantity |
|---|---|---|
| Embodiment 1 | $Ni(NO_3)_2 \cdot 6H_2O$ | 2~10 mmol |
| Ni(OH)F | $NH_4F$ | 4~10 mmol |
| | $Co(NH_2)_2$ | 10 mmol |
| Embodiment 2 | $Co(NO_3)_2 \cdot 6H_2O$ | 2~10 mmol |

TABLE 1-continued

| Embodiment | Contents | Quantity |
|---|---|---|
| Co(OH)F | $NH_4F$ | 4~10 mmol |
| | $Co(NH_2)_2$ | 10 mmol |
| Embodiment 3 | $NaPO_2H_2$ | 2~10 mmol |
| Co—P | $NH_4F$ | 4~10 mmol |
| | $Co(NH_2)_2$ | 10 mmol |

Electrode Preparation Method Embodiment 2

Figure 4:
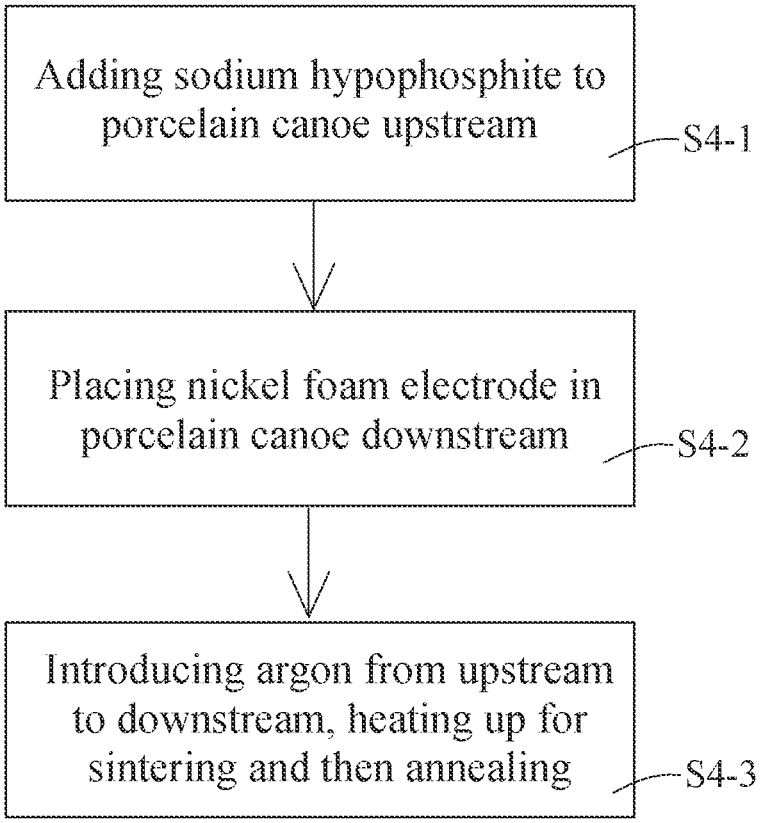
FIG. 4 is a flow chart of the second preferred embodiment of the preparation method of the nickel foam electrode of the present invention.

The present invention further provides a second preparation method for the electrode above, with reference to FIG. 4, the steps of which comprise:

Step 4-1) Adding 1.32 g of sodium hypophosphite to a crucible (or a porcelain crucible canoe) and setting it as upstream;

Step 4-2) Placing the nickel foam electrode in another crucible and setting it as downstream; and Step 4-3) Introducing argon from the upstream crucible into the downstream crucible and sintering and annealing at 350° C. for 2.30 hours, heating at a rate of 2° C./min, sodium hypophosphite will generate phosphorus gas and form a thin film on the metal surface of the nickel foam electrode to obtain the Ni—P phosphate-treated nickel foam electrode (embodiment 4 of the present invention).

<Design of Electrolysis Reaction Apparatus>

Figure 5:
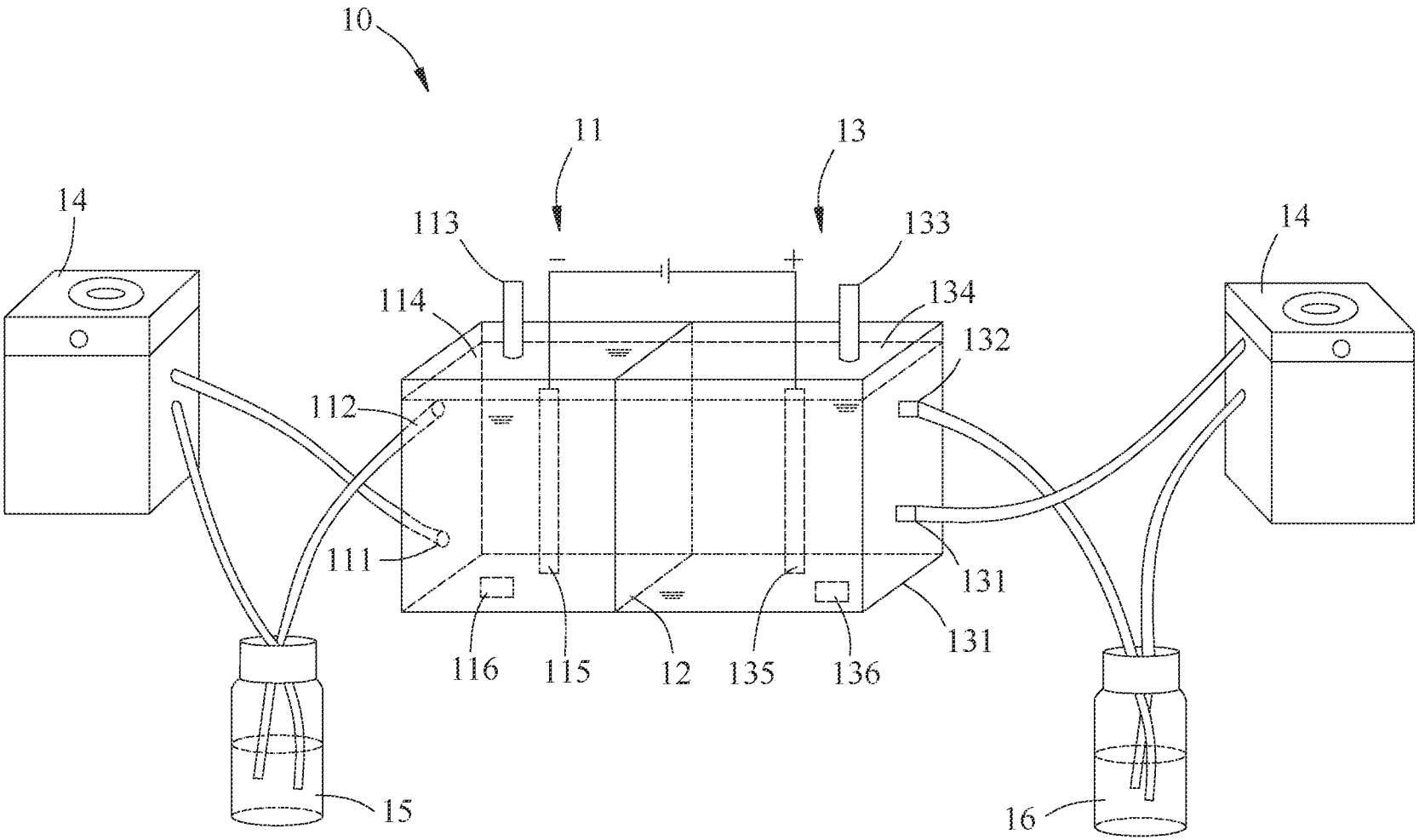
FIG. 5 is a schematic diagram of a preferred embodiment of the continuous electrolytic bath of the present invention.
Figure 6:
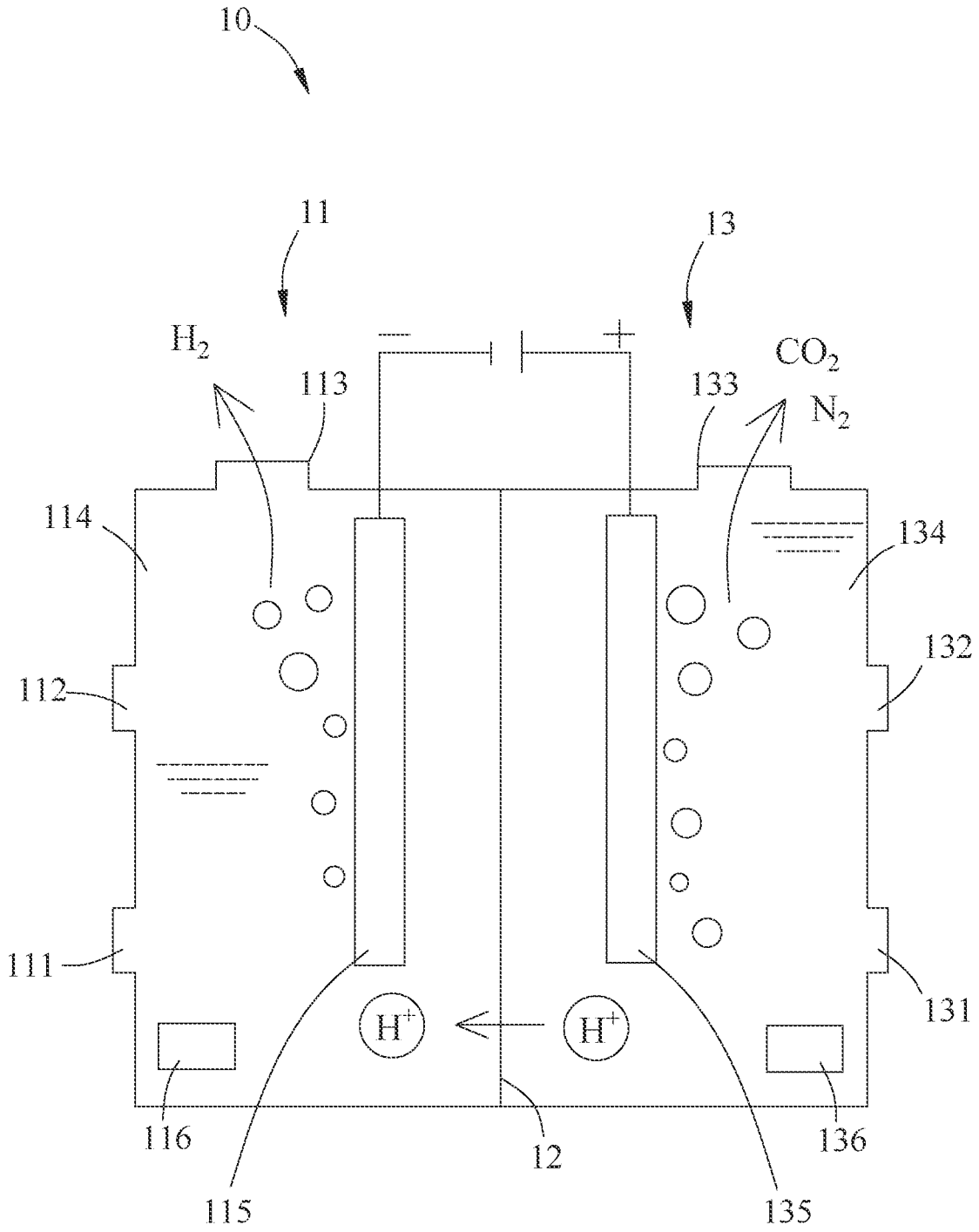
FIG. 6 is a schematic diagram of the chemical reaction of the continuous electrolytic bath of the present invention.

Referring to FIG. 5, the present invention applies the aforementioned modified nickel form electrode to a continuous electrolytic bath for the oxidation of urea. However, urea is one of the preferred embodiments of the present invention only. Other nitrogen-containing compounds can be also used for hydrogen generation by oxidative electrolysis using the continuous electrolytic bath 10 provided by the present invention.

More specifically, the continuous electrolytic bath 10 of the present invention includes a cathode reaction tank 11 and an anode reaction tank 13 which are separated from each other by an ion-permeable membrane 12, and the cathode reaction tank 11 is electrically connected to the anode reaction tank 13. The cathode reaction tank 11 may also be referred to as the negative reaction tank, and the anode reaction tank 13 may also be referred to as the positive reaction tank.

The cathode reaction tank 11 preferably comprises a cathode inlet 111, a cathode outlet 112, and a cathode gas outlet 113, the cathode reaction tank 11 comprises a nitrogen-containing compound reaction solution 114, the above-mentioned modified nickel form electrode 115 immersed in the nitrogen-containing compound reaction solution 114, and a reaction solution concentration monitor 116.

As shown in FIG. 5, for achieving continuous reaction, the cathode outlet 112 is preferably set above the cathode inlet 111, and the cathode inlet 111 is connected in series externally with a pump 14 and a nitrogen-containing compound raw material solution 15. The pump 14 sucks up the nitrogen-containing compound raw material solution 15 and supplies it into the cathode reaction tank 11 to form a nitrogen-containing compound reaction solution 114 and perform the reaction.

The anode reaction tank 13 preferably comprises an anode inlet 131, an anode outlet 132, and an anode gas outlet 133. The anode reaction tank 13 preferably comprises an anode reaction solution 134, an anode electrode 135 immersed in the anode reaction solution 134, and likewise a reaction solution concentration monitor 136.

Similarly, for achieving continuous reaction, preferably the anode outlet 132 is set above the anode inlet 131, and the anode inlet 131 is connected in series externally with another pump 14 and an anode reaction raw material solution 16. The pump 14 sucks up the anode reaction raw material solution 16 and supplies it into the anode reaction tank 13.

The reaction process of the continuous electrolytic bath 10 of the present invention comprises: the nitrogen-containing compound reaction solution 114 in the cathode reaction tank 11 is oxidized with the nickel form electrode 115, and the reaction equation is as follows:

$$6H_2O_{(l)}+6e^-\rightarrow 3H_{2(g)}+6OH^-$$

The reaction solution concentration monitor 116 continuously monitors the concentration of nitrogen-containing compounds or level of the electrolyte precursor solution in the nitrogen-containing compound reaction solution 114. When the concentration or the level falls below a preset value, the pump 14 will be activated to suck the nitrogen-containing compound raw material solution 15 or the electrolyte precursor solution and supply new nitrogen-containing compound raw material solution 15 or fresh electrolyte precursor solution from the cathode inlet 111 into the cathode reaction tank 11 and continue the electrolytic reaction. The reaction product contains hydrogen, which is collected through the cathode gas outlet 113 for subsequent hydrogen production and power generation applications. When the nitrogen-containing compound reaction solution 114 is too low in concentration in the cathode reaction tank 11, it will be discharged from the cathode outlet 112. The nitrogen-containing compound reaction solution 114 and the nitrogen-containing compound raw material solution 15 are preferably a urea solution in this embodiment.

In the anode reaction tank 13, a preferred embodiment of the anode reaction solution 134 may also be a urea solution, conducting a reaction with the following reaction equation in the anodic reaction tank 13:

$$CO(NH_2)_{2(aq)}+6OH^-\rightarrow N_{2(g)}+5H_2O_{(l)}+CO_{2(g)}+6e^-$$

The reaction solution concentration monitor 136 continuously monitors the concentration of the required reaction compound in the anode reaction solution 134, and when the concentration falls below a preset value, the pump 14 will be activated to suck the anode reaction raw material solution 16 and to supply a new anode reaction raw material solution 16 into the anode reaction tank 13 from the anode inlet 131 to continue the electrolytic reaction. The reaction product contains nitrogen and carbon dioxide gas, which is discharged and collected from the anode gas outlet 133. When the anode reaction solution 134 is too low in concentration in the anode reaction tank 13, it will be discharged from the anode outlet 132. In this embodiment, the anode reaction solution 134 and the anode reaction raw material solution 16 are preferably the same as the urea solution.

The ions reacted in the cathode reaction tank 11 and the anode reaction tank 13 will pass through the ion-permeable membrane 12 and react with each other.

<Electrical Efficiency Tests for Electrolysis Reaction Apparatus>

Figure 7:
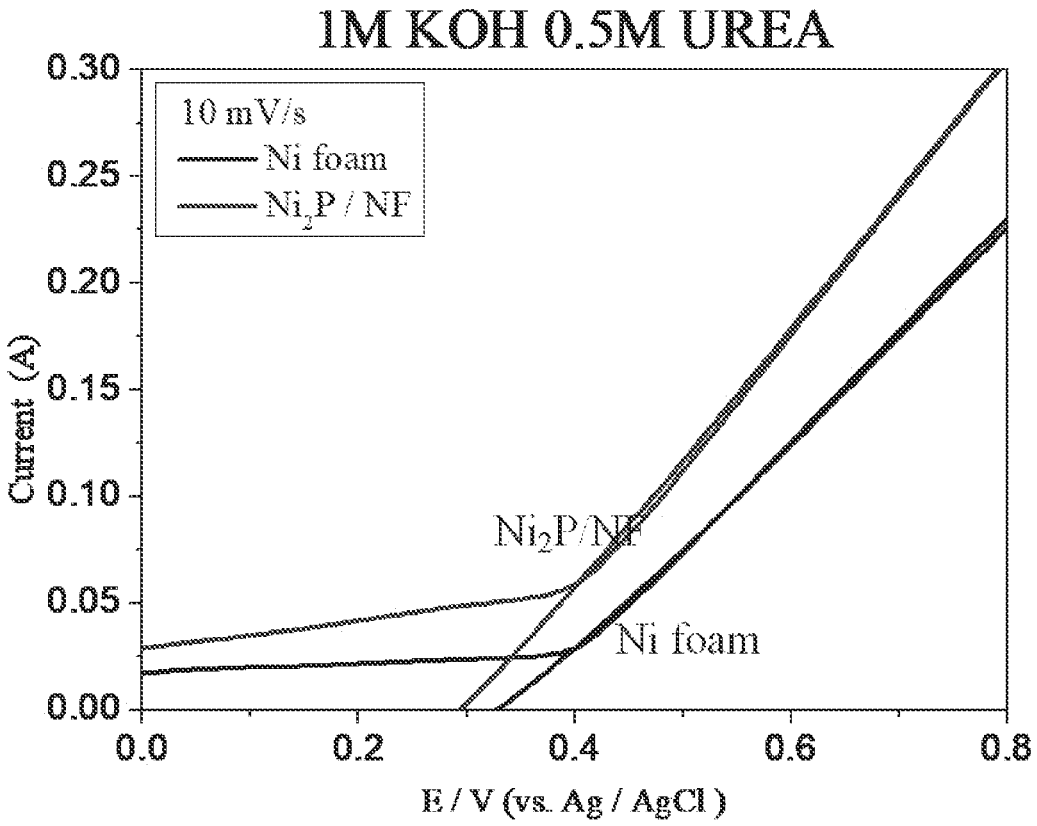
FIG. 7 is a linear scanning voltammetry test of the continuous electrolytic bath using the nickel foam electrode Embodiment 4 of the present invention.
Figure 8:
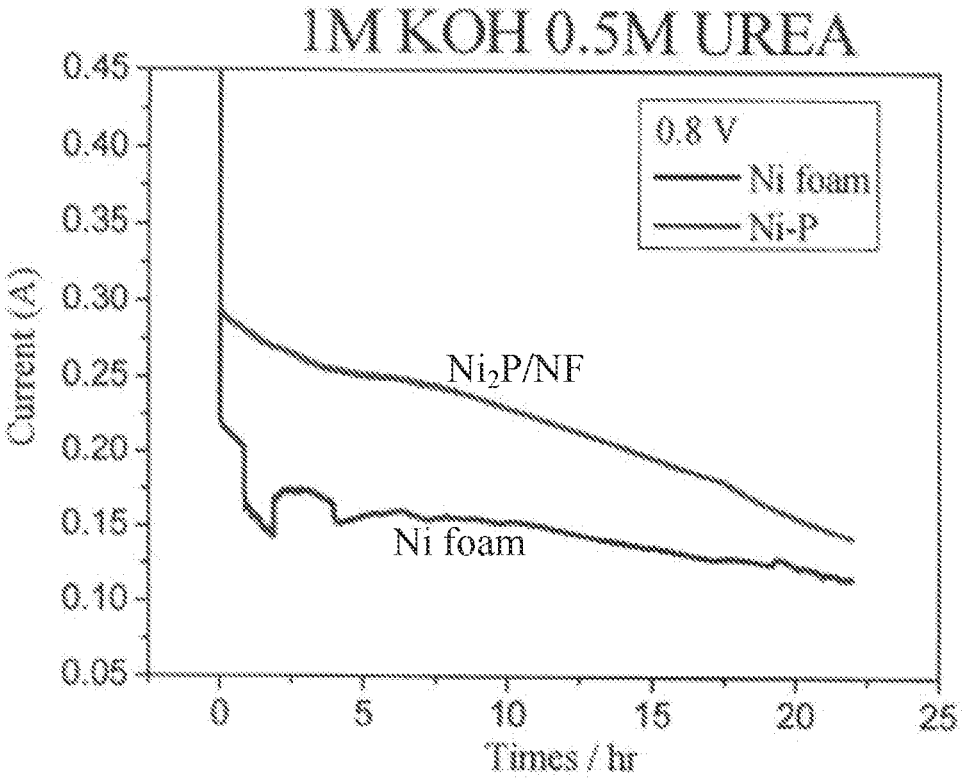
FIG. 8 is a test of the capacitance time characteristics under potential static control for the continuous electrolytic bath of the present invention.

Referring to FIGS. 7 and 8, they are the efficiency test of the continuous electrolytic bath 10 of Embodiment 4 of the present invention using the aforementioned modified high-efficiency nickel foam electrode 115.

FIG. 7 shows the linear scanning voltammetry (LSV) curves using the above embodiment 4, mainly using the urea solution (0.5 M urea precursor solution together with 1 M KOH) for the reaction test at a voltage of 10 mV/s. In FIG. 7, the unmodified nickel foam electrode is compared with the aforementioned phosphate-treated nickel foam electrode (Ni—P). It can be seen that at the same potential window, the present invention has a higher current quality using the phosphate-treated nickel foam electrode, indicating that the modified nickel foam electrode provided by the present invention has a higher urea electrolytic efficiency.

FIG. 8 shows the current-time characteristic curves (IT characteristic curves). Similarly, it can be seen that the urea capacity consumed by the modified nickel foam electrode provided by the present invention has a better effect than that of the unmodified nickel foam electrode when electrolyzed at a constant voltage of 0.8V for a long period of time.

Figure 9:
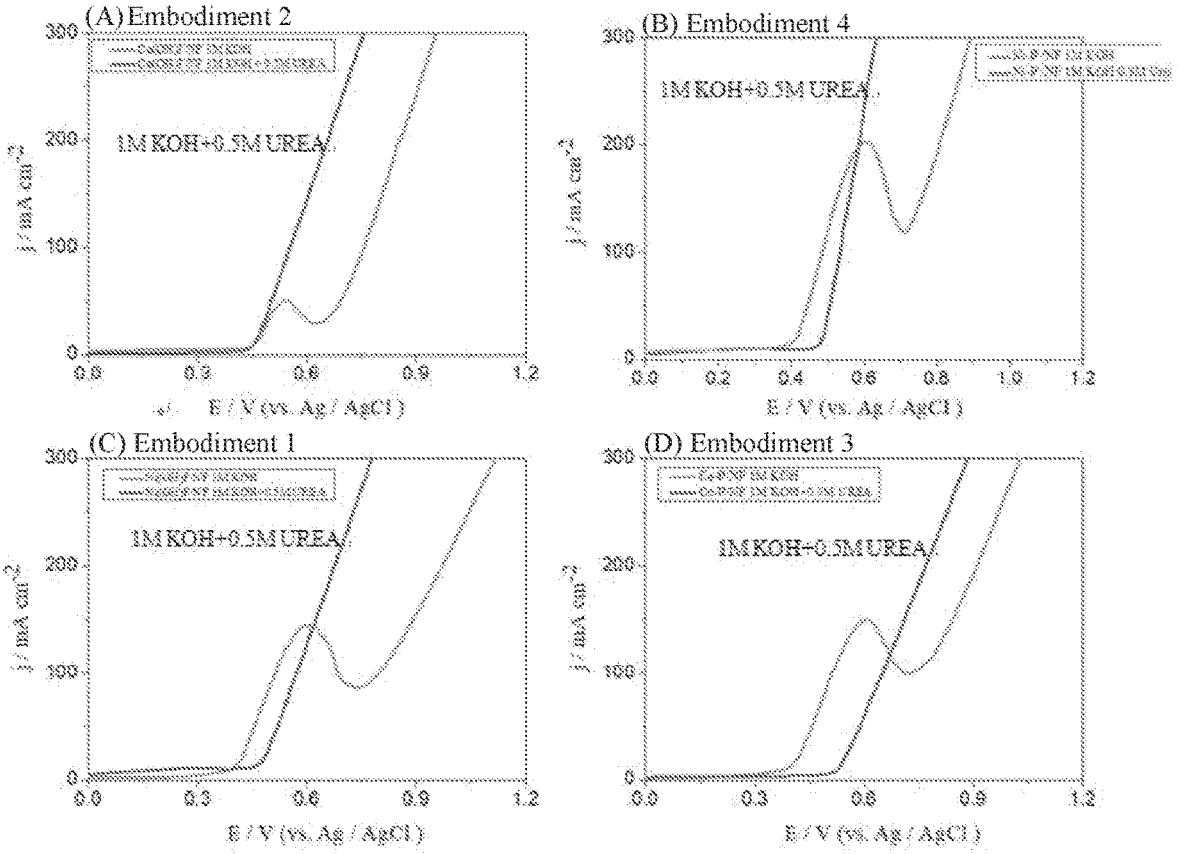
FIG. 9 is a linear scanning voltammetry test of the continuous electrolytic bath using the nickel foam electrode Embodiments 1~4 of the present invention.
Figure 10:
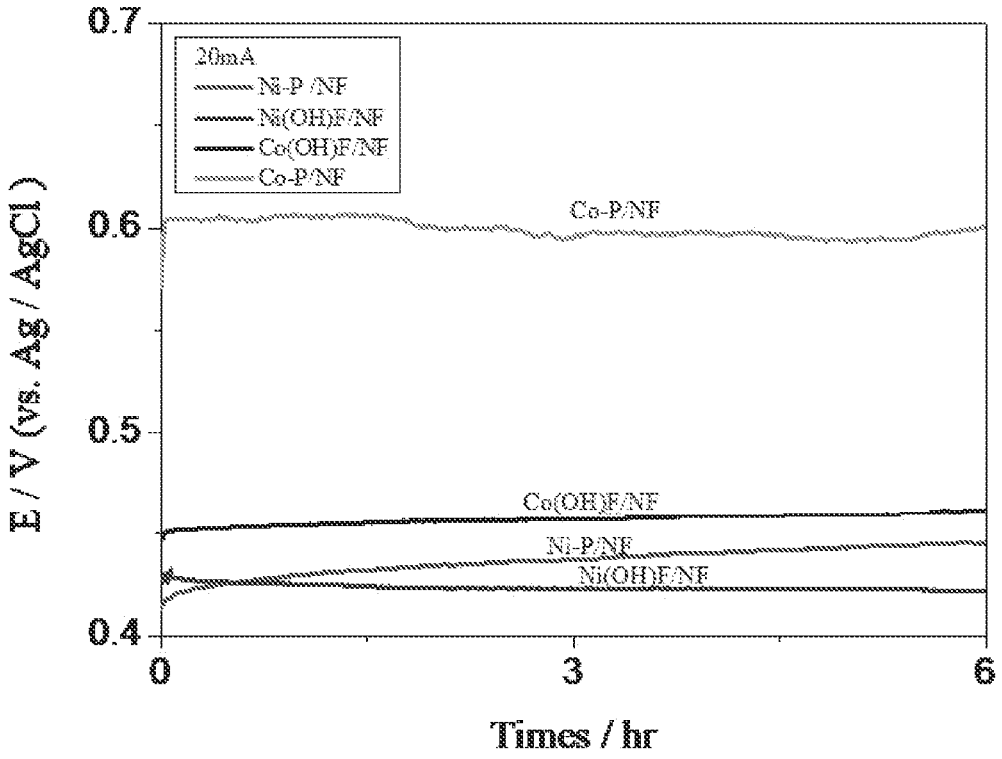
FIG. 10 is the potential time characteristic curves of the continuous electrolytic bath using the nickel foam electrode of Embodiments 1~4 of the present invention.

Referring to the curves of the linear scanning voltammetry of Embodiments 1~4 in FIG. 9, each of the embodiments were subjected to the oxidative electrolysis reaction with and without urea, respectively. As can be seen from the curves, the functional groups contained on the anode electrode in the embodiments of the present invention are capable of continuously oxidizing urea. The curves are linearly increasing. Referring to FIG. 10, which shows the curves of the potential-time characteristics of the nickel foam electrode of Embodiments 1~4, all of the embodiments of the present invention basically show a stable electrode potential, but among them, the Co—P nickel foam electrode of Embodiment 3 has a highest potential and the most stable effect.

The above specification, examples, and data provide a complete description of the present disclosure and use of exemplary embodiments. Although various embodiments of the present disclosure have been described above with a certain degree of particularity, or with reference to one or more individual embodiments, those with ordinary skill in the art could make numerous alterations or modifications to the disclosed embodiments without departing from the spirit or scope of this disclosure.

What is claimed is:

1. A preparation method for oxidization of nitrogen-containing compound electrode, the steps comprise:

providing a nickel foam electrode;

immersing the nickel foam electrode in a precursor solution containing precursors;

stirring or evenly dispersing the precursor solution containing the nickel foam electrode and precursors;

irradiating the precursor solution containing the nickel foam electrode and precursors in a microwave oven after completion of the dispersion, wherein the microwave irradiation induces in-situ growth of dendritic or flower-like nanostructures on a surface of the nickel foam electrode; the surface of the nickel foam electrode is distributed with modified inorganic and/or organic functional groups comprising cobalt oxide fluoride (Co(OH)F), cobalt phosphide (Co—P) nickel hydroxide fluoride (Ni(OH)F), phosphorus (P), or a combination of the four;

drying the microwave-treated nickel foam electrode; and annealing the dried nickel foam electrode to obtain a nitrogen-containing compound oxidation electrode having the dendritic or flower-like nanostructures on the surface thereof.

2. The preparation method for oxidization of nitrogen-containing compound electrode according to claim 1, wherein:

microwave is irradiating at 700~1000 W for 10 seconds each time for a total of 20 minutes, the irradiation conditions being sufficient to promote uniform nucleation and growth of said dendritic or flower-like nanostructures;

removing the excess of the precursor solvent by drying at 120° C. for 8 hours; and annealing at 320° C. for 2.3 hours with argon gas.

3. The preparation method for oxidization of nitrogen-containing compound electrode according to claim 2, wherein: the composition contained in the precursor solution comprises:

$Ni(NO_3)_2 \cdot 6H_2O$, $Co(NO_3)_2 \cdot 6H_2O$, or Co—P at 2-10 mmol;

$NH_4F$ at 4-10 mmol; and $CO(NH_2)_2$ at 10 mmol.

4. The preparation method for oxidization of nitrogen-containing compound electrode according to claim 2, wherein: the nickel foam electrode is pretreated prior to immersion in the precursor solution, the pretreatment comprises:

cutting the nickel foam electrode;

removing impurities from the nickel foam electrode using acetone;

adding 50 ml of 3M hydrochloric acid (HCl) and ultrasonic oscillation for 30 minutes; and cleaning the residual acidic components with deionized water and drying them in an oven to obtain a clean nickel foam electrode.

5. The preparation method for oxidization of nitrogen-containing compound electrode according to claim 1, wherein: the composition contained in the precursor solution comprises:

$Ni(NO_3)_2 \cdot 6H_2O$, $Co(NO_3)_2 \cdot 6H_2O$, or Co—P at 2-10 mmol;

$NH_4F$ at 4-10 mmol; and $CO(NH_2)_2$ at 10 mmol.

6. The preparation method for oxidization of nitrogen-containing compound electrode according to claim 5, wherein: the nickel foam electrode is pretreated prior to immersion in the precursor solution, the pretreatment comprises:

cutting the nickel foam electrode;

removing impurities from the nickel foam electrode using acetone;

adding 50 ml of 3M hydrochloric acid (HCl) and ultrasonic oscillation for 30 minutes; and cleaning the residual acidic components with deionized water and drying them in an oven to obtain a clean nickel foam electrode.

7. The preparation method for oxidization of nitrogen-containing compound electrode according to claim 1, wherein: the nickel foam electrode is pretreated prior to immersion in the precursor solution, the pretreatment comprises:

cutting the nickel foam electrode;

removing impurities from the nickel foam electrode using acetone;

adding 50 ml of 3M hydrochloric acid (HCl) and ultrasonic oscillation for 30 minutes; and cleaning the residual acidic components with deionized water and drying them in an oven to obtain a clean nickel foam electrode.

8. A continuous electrolytic reaction bath using the oxidized nitrogen-containing compound electrode, comprising a cathode reaction tank and an anode reaction tank separated by an ion-permeable membrane, and said cathode reaction tank and said anode reaction tank being electrically connected to each other, wherein:

the cathode reaction tank comprises a cathode inlet, a cathode outlet, and a cathode gas outlet, the cathode reaction tank comprises a nitrogen-containing compound reaction solution, the oxidized nitrogen-containing compound electrode according to claim 1 immersed in the nitrogen-containing compound reaction solution, and a reaction solution concentration monitor; the cathode outlet is set above the cathode inlet, and the cathode inlet is connected in series externally with a pump and a nitrogen-containing compound raw material solution, the pump sucks up the nitrogen-containing compound raw material solution and supplies it into the cathode reaction tank to form a nitrogen-containing compound reaction solution and performing the reaction;

said anode reaction tank comprises an anode inlet, an anode outlet, and an anode gas outlet, said anode reaction tank comprises an anode reaction solution, an anode electrode immersed in the anode reaction solution, and likewise a reaction solution concentration monitor;

said anode outlet is set above the anode inlet, and the anode inlet is connected in series externally with another pump and an anode reaction raw material solution, the pump sucking up the anode reaction raw material solution and supplying it into the anode reaction tank; and said reaction solution concentration monitor continuously monitors the concentration of nitrogen-containing compounds in the nitrogen-containing compound reaction solution, when the concentration falls below a preset value, the pump is activated to suck up the nitrogen-containing compound raw material solution and supply new nitrogen-containing compound raw material solution from the cathode inlet into the cathode reaction tank and continue the electrolytic reaction, and the gas contained in the reaction product is collected through the cathode gas outlet, and when the nitrogen-containing compound reaction solution is too low in concentration in the cathode reaction tank, it is discharged from the cathode outlet.

9. The continuous electrolytic reaction bath using the oxidized nitrogen-containing compound electrode according to claim 8, wherein: the nitrogen-containing compound reaction solution, the nitrogen-containing compound raw material solution, the anode reaction solution, and the anode reaction raw material solution comprise urea solution.

10. The continuous electrolytic reaction bath using the oxidized nitrogen-containing compound electrode according to claim 9, wherein:

the nitrogen-containing compound reaction solution in the cathode reaction tank is oxidized with the nickel form electrode, the reaction equation being: $6H_2O_{(l)}+6e^- \rightarrow 3H_{2(g)}+6OH^-$, and the hydrogen gas is discharged and collected from the cathode gas outlet; and the anode reaction solution in the anode reaction tank forms the reaction equation: $CO(NH_2)_{2(aq)}+6OH^- \rightarrow N_{2(g)}+5H_2O_{(l)}+CO_{2(g)}+6e^-$, and the nitrogen and carbon dioxide gas are discharged and collected from the anode gas outlet.

11. The continuous electrolytic reaction bath using the oxidized nitrogen-containing compound electrode according to claim 10, wherein: the reaction solution concentration monitor continuously monitors the concentration of the required reaction compound in the anode reaction solution, and when the concentration falls below a preset value, the pump is activated to suck the anode reaction raw material solution and to supply a new anode reaction raw material solution into the anode reaction tank from the anode inlet to continue the electrolytic reaction, and when the anode reaction solution in the anode reaction tank is too low in concentration, it is discharged from the anode outlet.

12. The continuous electrolytic reaction bath using the oxidized nitrogen-containing compound electrode according to claim 9, wherein: the reaction solution concentration monitor continuously monitors the concentration of the required reaction compound in the anode reaction solution, and when the concentration falls below a preset value, the pump is activated to suck the anode reaction raw material solution and to supply a new anode reaction raw material solution into the anode reaction tank from the anode inlet to continue the electrolytic reaction, and when the anode reaction solution in the anode reaction tank is too low in concentration, it is discharged from the anode outlet.

13. The continuous electrolytic reaction bath using the oxidized nitrogen-containing compound electrode according to claim 8, wherein: the reaction solution concentration monitor continuously monitors the concentration of the required reaction compound in the anode reaction solution, and when the concentration falls below a preset value, the pump is activated to suck the anode reaction raw material solution and to supply a new anode reaction raw material solution into the anode reaction tank from the anode inlet to continue the electrolytic reaction, and when the anode reaction solution in the anode reaction tank is too low in concentration, it is discharged from the anode outlet.

* * * * *